United States Patent [19]

Crowley

[11] Patent Number: 4,581,867

[45] Date of Patent: Apr. 15, 1986

[54] REFRACTORY ANCHOR

[75] Inventor: Michael S. Crowley, Chicago Heights, Ill.

[73] Assignee: Standard Oil Company (Indiana), Chicago, Ill.

[21] Appl. No.: 656,033

[22] Filed: Sep. 28, 1984

Related U.S. Application Data

[63] Continuation-in-part of Ser. No. 331,181, Dec. 16, 1981, Pat. No. 4,479,337, which is a continuation of Ser. No. 140,174, Apr. 14, 1980, abandoned.

[51] Int. Cl.[4] ..... E04B 1/24; E04C 2/04

[52] U.S. Cl. ..... 52/378; 52/334; 52/443; 52/506

[58] Field of Search ..... 52/336, 334, 378, 379, 52/249, 600, 443, 506, 509, 442, 426; 110/246, 336, 337, 338, 339, 331

[56] References Cited

U.S. PATENT DOCUMENTS

| | | | |
|---|---|---|---|
| 745,547 | 12/1903 | Wight | 52/379 |
| 1,590,650 | 6/1926 | Schack | 52/442 X |
| 1,941,282 | 12/1933 | Symington | 52/378 |
| 3,076,481 | 2/1963 | Wygant | 52/378 X |
| 3,103,042 | 9/1963 | Martin | 52/506 X |
| 3,277,626 | 10/1966 | Brynjolfsson et al. | 52/379 X |
| 3,336,712 | 8/1967 | Bartley | 52/378 |
| 3,366,375 | 1/1968 | Jones | 110/331 X |
| 3,587,198 | 6/1971 | Hensel | 52/378 X |
| 4,040,224 | 8/1977 | Harris | 52/509 |
| 4,177,616 | 12/1979 | Lampert | 52/506 X |
| 4,348,847 | 9/1982 | Jukes | 52/426 |
| 4,479,337 | 10/1984 | Crowley | 52/378 |

FOREIGN PATENT DOCUMENTS

| | | | |
|---|---|---|---|
| 1096583 | 1/1961 | Fed. Rep. of Germany | 52/378 |
| 8914 | of 1910 | United Kingdom | 52/378 |

*Primary Examiner*—John E. Murtagh
*Assistant Examiner*—Richard E. Chilcot, Jr.
*Attorney, Agent, or Firm*—Thomas W. Tolpin; William T. McClain; William H. Magidson

[57] ABSTRACT

Specially configured refractory anchors are provided to minimize erosion and increase the useful life of refractory linings in reactors and other vessels. The refractory anchors have a frustroconical base and an overhead crossbar with an intermediate portion and opposite ends. At least one of the opposite ends has an arcuate portion to provide a curved baffle to arcuately deflect and block gases flowing along the refractory lining adjacent to the refractory anchors. Desirably, the crossbar provides an erosion resistant barrier to help protect the structural integrity of the refractory linings. The base extends downwardly from the crossbar and reinforces the refractory lining. The flared sides of the base diverge towards the opposite ends of the crossbar at obtuse angles of inclination to provide pockets for receiving and holding the refractory lining. In one embodient, the refractory anchor has an S-shaped crossbar with reverse bent opposite ends. In another embodiment, the refractory anchor has a C-shaped crossbar with symmetrical arcuate ends.

21 Claims, 11 Drawing Figures

REFRACTORY ANCHOR

CROSS-REFERENCES TO RELATED APPLICATIONS

This application is a continuation-in-part of application Ser. No. 331,181, filed Dec. 16, 1981, U.S. Pat. No. 4,479,337, issued Oct. 30, 1984, entitled "Refractory Anchor", which is a continuation of application Ser. No. 140,174, filed Apr. 14, 1980, entitled "Refractory Anchor", abandoned.

BACKGROUND OF THE INVENTION

This invention relates to monolithic refractory linings in process vessels and equipment such as reactors, conduits, furnaces, incinerators and the like and, more particularly, to anchors for reinforcing and protecting refractory linings from erosion.

Refractory liners have been used for many years in process vessels, reactors, conduits, furnaces and the like to provide thermal insulation and in environments such as fluidized catalytic reactors, regenerators, or stacks, to provide resistance to abrasion and erosion. Refractory liners not only serve to thermally insulate a vessel, but also prolong the useful life of the vessel by shielding it from erosion and abrasion. In fluid catalytic cracking units for petroleum hydrocarbons, the abrasive effect of entrained cracking catalyst is very pronounced because of high fluid velocities on the order of 50 to 150 ft/second. High temperatures also occur in both the fluid bed reactor and the regenerator. For example, in the reactor the temperature may be 800°-1100° F. In the regenerator, the temperature of gases exiting through the cyclones may be on the order of 1250°-1450° F. It has been the usual practice to line vessels, conduits and cyclone separators, through which fluid with entrained catalyst flows, with refractory liner to prevent erosion of the metal surfaces and to provide thermal insulation. The refractory liner can be a refractory cement, or concrete.

In order to retain the refractory, various anchoring arrangements have beem employed. U.S. Pat. No. 3,076,481 to Wygant, which is hereby incorporated by reference, describes many of the problems involved in anchoring refractory concrete linings and of a particular anchorage arrangement.

Heretofore, a preferred anchorage arrangement which provided some erosion protection was the use of hexagonal steel grating which was welded to the vessel or conduit wall. The refractory was deposited in the hexagonal spaces defined by the hexagonal grating. The hexagonal grating provided the desired erosion resistance for the refractory by projecting to the exposed surface of the refractory. The many disadvantages of hexagonal grating, however, are its relatively high cost, lack of flexibility which makes it difficult to apply to curved surfaces, its tendency to separate from the vessel or conduit wall over relatively large areas when welds fail, and its unsuitability for use with fiber reinforced refractories or with refractory concretes containing coarse aggregate particles.

In situations where hexagonal grating is not suitable, weldable studs, such as those described in U.S. Pat. No. 3,657,851 to Chambers et al and U.S. Pat. No. 3,336,712 to Bartley, have been proposed. Such studs are suitable for use with fiber reinforced refractory or with refractory concrete but do not provide erosion protection for the refractory.

Over the years, a number of refractory anchors and other devices have been suggested. Typifying these prior art refractory anchors and other devices are those shown in U.S. Patent Nos. 78,167; 1,624,386; 2,340,176; 2,479,476; 3,076,481; 3,177,619; 3,424,239; 3,429,094; 3,449,084; 3,500,728; 3,564,799; and 3,587,198. These prior art refractory anchors and other devices have met with varying degrees of success.

It is therefore desirable to provide an improved refractory anchor which overcomes most, if not all, of the above problems.

SUMMARY OF THE INVENTION

An improved refractory anchor is provided to minimize erosion and increase the useful life of refractory linings in reactors and other vessels. The novel refractory anchor has a unique overhead elongated crossbar and a specially configured base. The overhead crossbar has an intermediate portion with opposite ends. At least one of the opposite ends of the crossbar has an arcuate portion that provides a curved baffle to arcuately deflect and substantially block high velocity gases which flow along the refractory lining adjacent to the refractory anchor. The uniquely shaped base extends downwardly from the intermediate portion of the crossbar to reinforce the refractory lining. The base has upwardly diverging flared sides which intersect the crossbar. The sides of the base intersect the opposite ends of the crossbar at obtuse angles of inclination and cooperate with the ends of the crossbar to provide pockets which receive the refractory linings.

In one preferred form, the specially configured base of the refractory anchor has a generally planar or flat, frustroconical body portion. The frustroconical body portion is positioned in general coplanar relationship with the intermediate portion of the crossbar. The frustroconical base preferably has at lease one hole, along its vertical centerline and axis to receive and engage the refractory lining. The base cooperates with the crossbar to provide a generally T-shaped member as viewed from the front.

In the preferred embodiment, an S-bar or S-shaped refractory anchor is provided. The opposite ends of the crossbar of the S-bar refractory anchor have reverse bent arcuate portions which cooperate with each other and an intermediate portion of the crossbar to provide an S-shaped crossbar.

In another embodiment, a C-bar or C-shaped refractory anchor is provided. The opposite ends of the crossbar of the C-bar refractory anchor have laterally symmetrical C-shaped arcuate portions. The C-shaped opposite ends of the crossbar face generally inwardly towards each other and cooperate with each other and the intermediate portion of the crossbar to provide a C-shaped crossbar.

The refractory anchors of this invention are particularly adapted for installation by welding to a metal surface together with a number of similar anchors to provide anchorage for a monolithic refractory lining applied to the metal wall or surface.

Each refractory anchor is preferably fabricated and formed from a metal strip having its width substantially equal to the thickness of the refractory lining to be applied to the surface. The metal strip is cut on each end to provide cut-away portions on the side of the refractory anchor to be welded to the surface. The slanted tapered sides of the frustroconical base are preferably cut to intersect the outwardly extending arms of the crossbar at an angle of inclination of 95 degrees to 150 degrees. Holes and accompanying optional tabs can be punched in the base of the refractory anchors. Desirably, the refractory anchor is stamped from sheet metal so that its crossbar has extending arms with opposite ends which extend outwardly from the intermediate portion of the crossbar and the base. At least one of the outwardly extending arms is bent to provide an arcuate portion.

In the preferred embodiment, both of the outwardly extending arms are bent in opposite directions away from the plane of the base and intermediate portion of the crossbar to form an S-shaped crossbar.

In order to form a C-bar refractory anchor, the outwardly extending arms of the crossbar are bent towards each other away from the plane of the base and the intermediate portion of the crossbar to form symmetrical C-shaped arcuate portions at the ends of the crossbar.

Each of the arcuate portions of the S-shaped and C-shaped crossbars extend arcuately from 60 degrees to 270 degrees from the beginning to the end of the arcuate portion. The outwardly extending curved arms of the crossbar provide an erosion resistant barrier to help protect and reinforce the refractory lining.

In the preferred method of installation, the refractory anchors are arranged in alternate rows oriented at different angles and welded or otherwise securely attached to the walls of a reactor or another vessel.

Advantageously, the refractory anchors are relatively inexpensive and easy to install. The refractory anchors are suitable for use with fiber or needle reinforced refractory cement or concrete to help protect the refractory from erosion. The refractory anchors can be utilized on curved surfaces such as within the interior walls of cyclones, conduits, riser reactors, transfer lines, etc.

A more detailed explanation of the invention is provided in the following description and appended claims taken in conjunction with the accompanying drawings.

DETAILED DESCRIPTION OF THE PREFERRED EMBODIMENT

Figure 1:
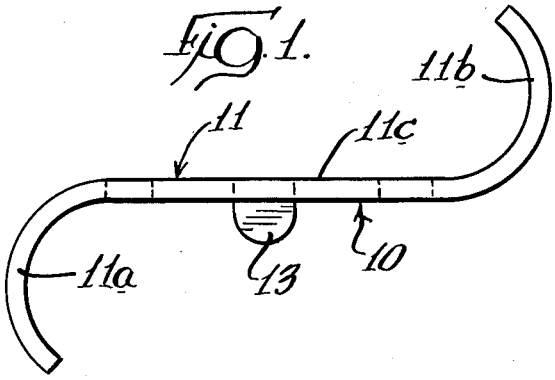
FIG. 1 is a top plan view of an S-shaped refractory anchor from the side adapted to be welded to the walls of the reactor or other vessel to which the refractory is to be applied in accordance with principles of the present invention.

The S-shaped refractory anchors 10 in FIGS. 1–4 and 6–8, which are also referred to as S-bar refractory anchors, are preferably stamped from a strip of sheet metal, such as stainless steel, having its width equivalent to the thickness of the refractory liner to be applied. By stamping or otherwise cutting refractory anchors with outwardly extending arms 11*a* and 11*b* (FIGS. 1–3) on opposite ends of the strip, considerable metal can be saved. At the time of stamping, at least one hole or opening 12 (FIGS. 2 and 3) and projecting tab 13 can be formed along the vertical centerline of the central intermediate generally planar or flat frustroconical body portion 14*a* (FIG. 2) of the strip. If desired, no holes or a plurality of holes can be provided and the holes optionally can be with or without tabs. As will be described, the holes and tabs perform useful functions in the application of the refractory and in most cases their incorporation in the anchor will be desirable. Each of the arms 11*a* and 11*b* of the anchor 10 can be bent simultaneously during stamping to a curvature ranging from 60 degrees to 270 degrees from the beginning to the end of each arm (arcuate portion) and preferably from about 100 degrees to about 180 degrees relative to the intermediate portion 11*c* of the crossbar at the time of stamping or cutting of the anchors or in a subsequent operation depending on the availability of appropriate equipment.

The S-bar refractory anchor 10 has a generally S-shaped crossbar 11 with an elongated, generally planar or flat, intermediate portion 11*c* and reverse bent arcuate opposite ends 11*a* and 11*b* that provide outwardly extending arms. The reverse bent ends are cantilevered from the intermediate portion 11*c* and provide complimentary curved baffles to arcuately deflect and block gases flowing along the refractory linings 17 and 18 (FIG. 3) adjacent to the refractory anchor. The reverse bent ends of the crossbar are bent in a transverse direction, normal to and away from the plane of the frustroconical base. Advantageously, the crossbar provides an erosion resistant barrier which protects the structural integrity of the refractory linings.

Figure 2:
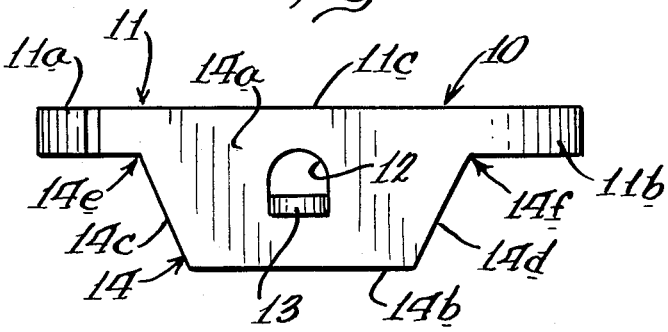
FIG. 2 is a front view of the S-shaped refractory anchor.
Figure 8:
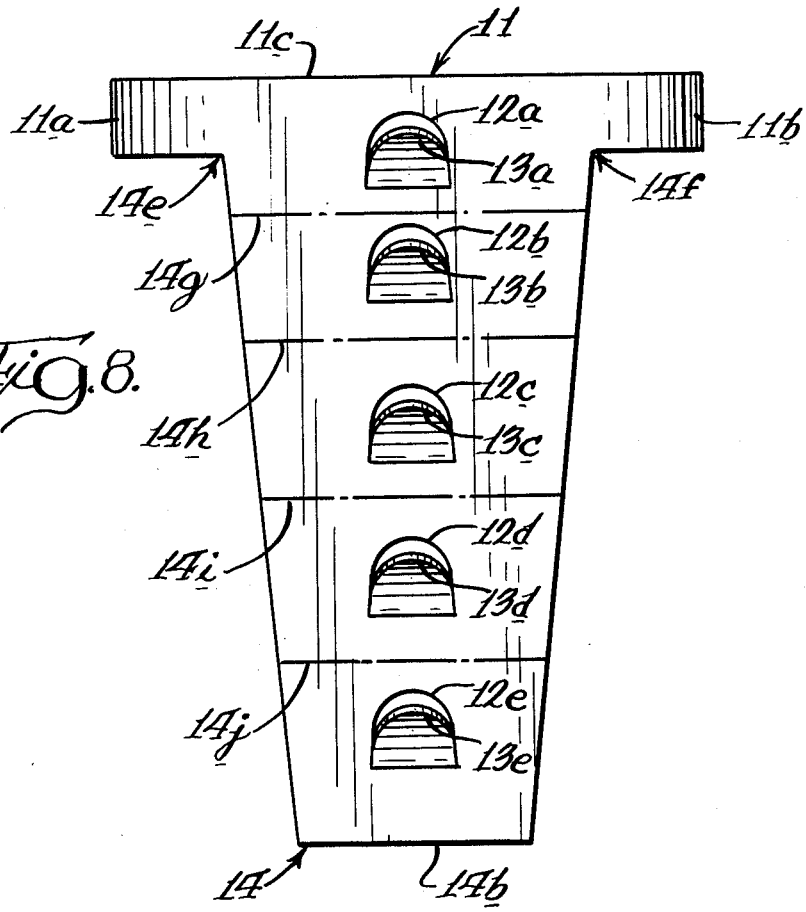
FIG. 8 is a front view of the S-shaped refractory anchor of FIG. 6.

The S-shaped refractory anchor has a generally frustroconical, planar or flat base 14 (FIG. 2) which integrally extends from and is connected to the intermediate portion 11*c* of the S-shaped crossbar 11 to reinforce the refractory lining. The frustroconical base 14 has a lower bottom portion, bottom edge, or bottom 14*b* which spans a lateral distance less than the intermediate portion 11*c* of the crossbar. The frustroconical base has flared, slanted, tapered sides 14*c* and 14*d* which diverge generally towards and intersect the reverse bent arcuate ends of the S-shaped crossbar at obtuse angles of inclination ranging from 95 degrees to 150 degrees, preferably a maximum of 135 degrees for best results, to define obtuse pockets 14*e* and 14*f* therewith for receiving the refractory lining 18. The base has a generally planar or flat frustroconical body portion which is positioned in coplanar relationship with the intermediate portion 11*c* of the crossbar. The base and the crossbar cooperate with each other to provide a generally T-shaped member as viewed from the front, as best shown in FIGS. 2 and 8, as well as during the fabrication process preparatory to bending the outwardly extending arms of the crossbar.

The frustroconical base 14 can have an overall height ranging from 0.25 inch to 6 inches and preferably from 0.5 inch to 3.75 inches for best results. The S-shaped crossbar has a total curved overall length or flattened length of 2 to 6 inches and preferably a maximum of about 5.5 inches for best results. The overall length or flattened length of the crossbar can be at least twice the height of the frustroconical base.

The holes 12 (FIGS. 2 and 3) in the frustroconical base receive and engage a refractory lining 18 and should be substantially smaller than the total surface area of the base 14. The hole can be circular, arch-shaped, or N-shaped. Other shaped holes can be provided.

The top edge of the crossbar 11 is generally straight, planar, and flat and extends across the ends 11*a* and 11*b* and the intermediate portion 11*c* of the crossbar. The flat top edge of the crossbar is perpendicular to the vertical axis of the frustroconical base 14.

The size of the anchors can be varied as desired for use with the surface to be refractory lined and the thickness and type of the refractory to be employed. A convenient anchor for securing a refractory one-inch thick is made from 16 gauge Type 304 stainless steel strip one inch wide. The length of the anchor prior to bending the arms 11 is approximately 5.5 inches and each arm is bent to a one-half inch radius. The width of the arms 11 can be $\frac{1}{4}$ to $\frac{1}{2}$ inch, as desired. The spacing of the anchors when they are welded to the surface to be refractory coated is a function of the size of the anchors. For the above-described size anchor, the anchors can be spaced apart over the surface upon three-inch centers. Thicker linings may have anchor spacings of 2 to 3 times the thickness or height of the anchor.

Figure 3:
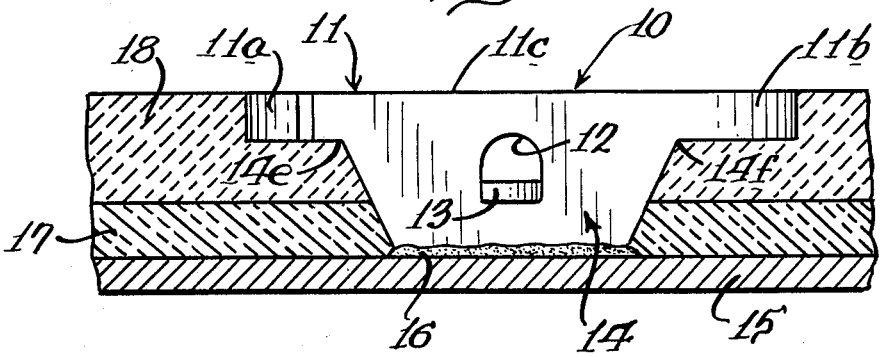
FIG. 3 is a front view of the S-shaped refractory anchor welded to the walls of the reactor with the refractory in place.

In FIG. 3, the anchor 10 is shown welded to a surface 15 of a reactor or other vessel, with the weld being indicated at 16. A similar weld can be utilized on the back side of the anchor. Two layers of refractory 17 and 18 are shown. The layer 17 next to the surface 15 is preferably of a refractory material having a high insulating value and the other layer 18 has a higher resistance to abrasion and erosion. Either or both of these layers can be reinforced by fibers (sometimes referred to as needles) which are preferably formed of stainless steel. Typically, the fibers will be approximately $\frac{3}{4}$ to $1\frac{1}{2}$ inches in length and about 20 mil (0.020 inch) in diameter. The quantity of fibers usually employed is between about 2 and 6% by weight of the refractory on a dry basis.

In cases where it is desired to utilize a refractory concrete, layer 17 can comprise expanded shale or vermiculite having high insulating value and layer 18 can comprise tabular alumina having high resistance to abrasion. In such cases, the projecting tabs 13 or holes 12 can be used as very convenient indicators as to the desired thickness of the insulating layer 17. This ability to conveniently measure the thickness of the applied layer is particularly useful when very thick layers of total refractory are involved.

Figure 4:
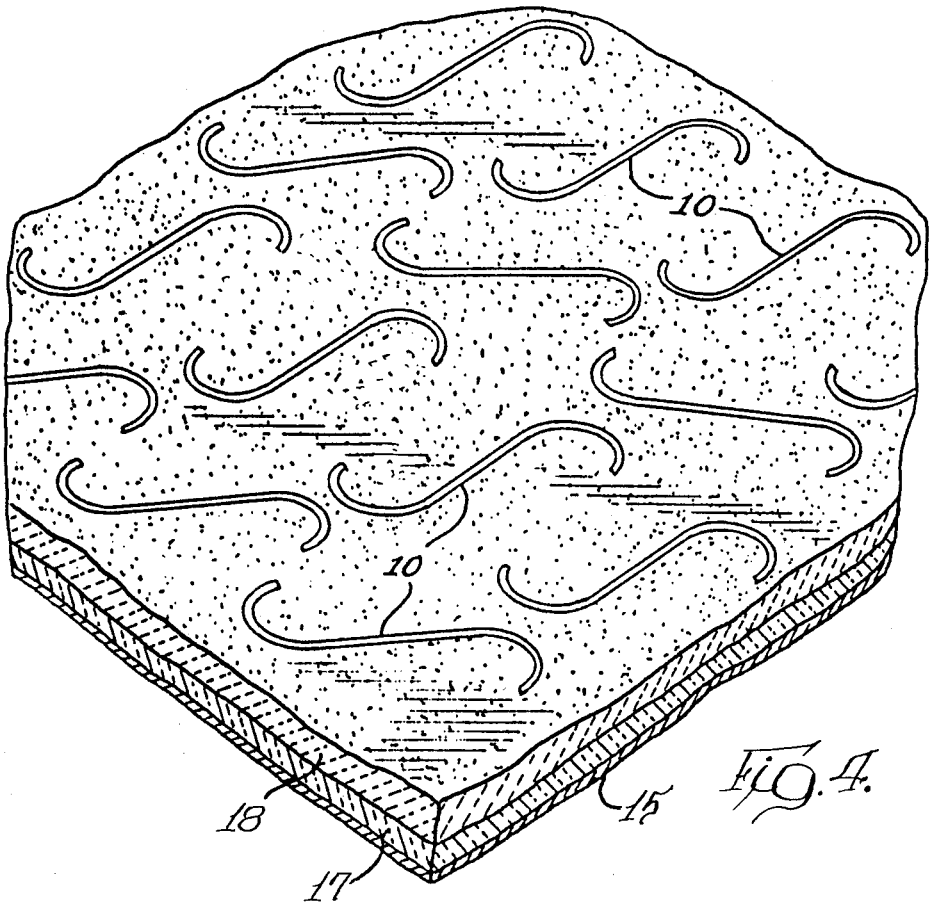
FIG. 4 is a fragmentary isometric view of an array of S-shaped refractory anchors attached to the walls of the reactor with the refractory linings in place.

In FIG. 4, the preferred composite structure is illustrated. Initially, the individual anchors 10 are affixed to the surface 15 to be protected by the refractory. As shown, alternate rows of the S-shaped refractory anchors are disposed at substantially different angles to each other and because of their curving arms an effective grid of metal is provided over the surface for preventing erosion. The preferred angular difference between the S-shaped refractory anchors of adjacent rows is about 45° or somewhere between about 30° and about 60° for achieving maximum erosion protection with a minimum number of anchors.

The anchors can be held in the desired position by means of a small bar having a slot in one end to receive the intermediate portion or top 11*c* of the anchor and welded to the wall or surface 15 by forming the welding bead 16 (FIG. 3) on one or both sides. When the weld is completed, the bar is pulled free for use to hold the next anchor. Alternatively, multiple tack welding or brazing, if appropriate to the metals involved, may be employed. When the anchors are all attached, the layer or layers of refractory cement, refractory concrete, or fiber reinforced refractory can be applied utilizing conventional procedures such as casting and trowelling or pneumatic application such as the Gunnite procedure.

Suitable refractories are the hydraulic calcium aluminate cements and the high alumina phosphate bonded materials which are heat setting and have superior erosion resistance. Once the refractory layer or layers have been applied and cured, they are very effectively held in place by the refractory anchors of this invention. When installed, the refractory lining is held against the surface or wall 15 by the arms 11*a* and 11*b* and tab(s) 13 and other portions of the refractory anchors and is continuous through the hole 12. Because the refractory anchors are not interconnected and have relative flexibility in their structure, thermal expansion and contraction can readily occur on a localized basis. Moreover, the protective blocking effected by the refractory anchors prevents abrasive erosion especially by streams of particulates such as fluidized catalyst which move transverse to the surface of the refractory. In contrast, the use of prior art hexagonal grating, while providing some erosion protection, has relatively little holding power to safely secure the refractory to the wall or interior surface of the vessel which is being protected. Moreover, when such prior art gratings separate from the surface, large sections are likely to pull loose from the surface.

Figure 6:
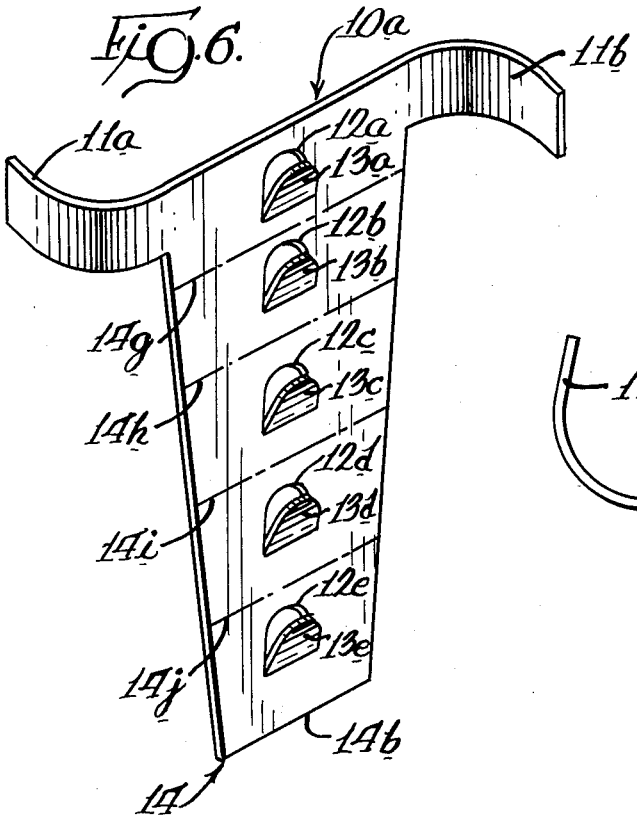
FIG. 6 is a perspective view of another S-shaped refractory anchor in accordance with principles of the present invention.
Figure 7:
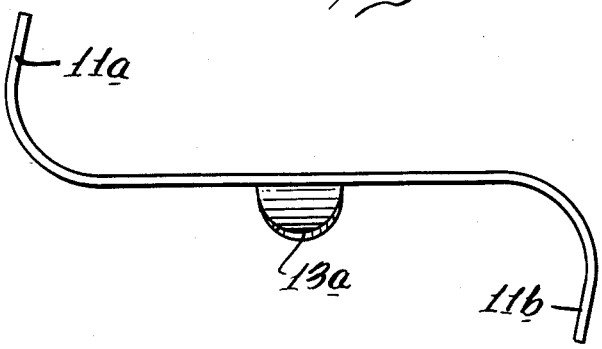
FIG. 7 is a top view of the S-shaped refractory anchor of FIG. 6.

The S-shaped refractory anchor 10*a*, shown in FIGS. 6–8, is also referred to as an S-bar refractory anchor, and is similar to the S-shaped refractory anchor shown in FIGS. 1–3, except that it is taller and has a set of vertically aligned holes 12*a–e* and tabs 13*a–e* along its vertical centerline. The refractory anchor 10*a* also can have horizontal score, break, or cutting lines 14*g–j*. The cutting lines 14*g–j* indicate where the refractory anchor can be cut to shorten the height and overall size of the anchor.

Figure 5:
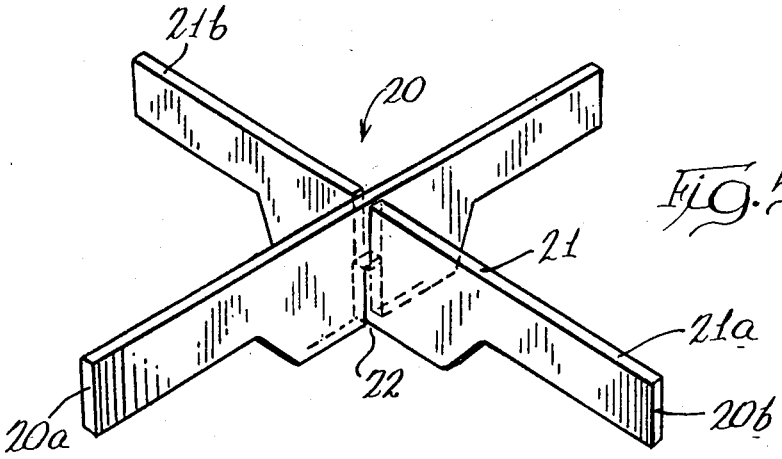
FIG. 5 is a perspective view of an X-shaped refractory anchor in accordance with principles of the present invention.

The X-shaped refractory anchor 20 of FIG. 5 is similar in many respects to the S-shaped anchors shown in FIGS. 1–4 except that the crossbars 21 have flat non-curving ends 21*a* and 21*b* and are slotted as shown at 22 so as to be interlockable in the form of a cross or X with similar anchor sections. Assembled in this manner, a pair of anchor sections 20*a* and 20*b* can be welded to a wall or other surface of a reactor or other vessel to protect and reinforce the refractory linings. The anchors shown in FIG. 5 can be readily arranged with the arms 21*a* and 21*b* of adjacent assemblies lying in non-touching but overlapping relationship to obtain a protection from erosion similar to that obtainable with hexagonal grating but without the disadvantages of continuous gratings.

Figure 9:
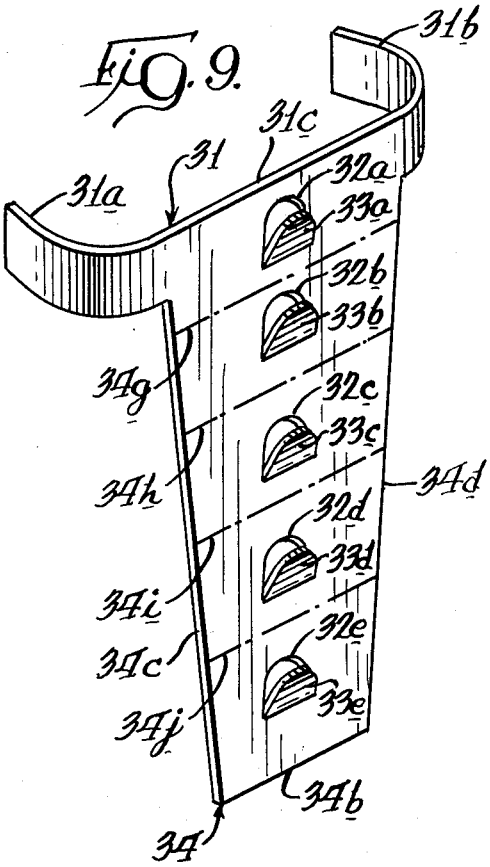
FIG. 9 is a perspective view of a C-shaped refractory anchor in accordance with principles of the present invention.
Figure 10:
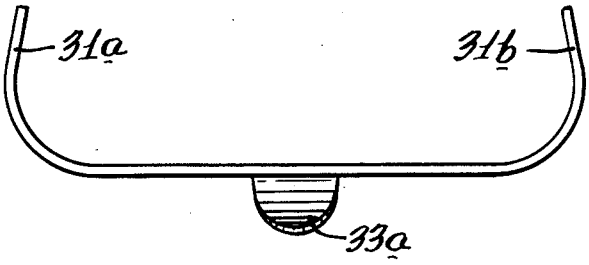
FIG. 10 is a top view of the C-shaped refractory anchor of FIG. 9.
Figure 11:
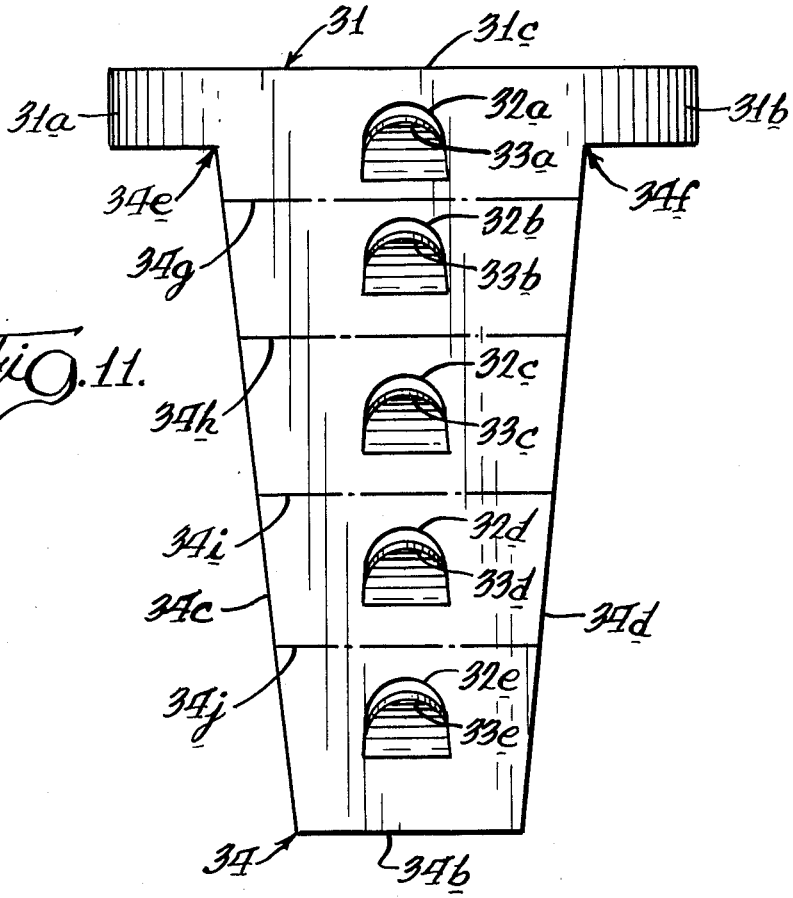
FIG. 11 is a front view of the C-shaped refractory anchor of FIG. 9.

The C-shaped refractory anchor 30 shown in FIGS. 9–11 is also referred to as a C-bar refractory anchor, and is similar to the S-shaped refractory anchor 10*a* shown in FIGS. 6–8, except that the C-shaped refractory anchor has a C-shaped crossbar 31 instead of an S-shaped crossbar. The C-shaped crossbar has a generally flat or planar intermediate portion 31*c* with symmetrical C-shaped opposite ends 31*a* and 31*b* which provide outwardly extending arms. The C-shaped opposite ends are cantilevered from the intermediate portion 31*c* and generally face each other to provide symmetrical curved baffles to arcuately deflect and block gases flowing along the refractory lining adjacent to the refractory anchor. The intermediate portion 31*c* of the crossbar extends between and connects the C-shaped opposite ends 31*a* and 31*b*. The generally planar or flat, straight top edge 31 of the crossbar extends across the crossbar and is generally perpendicular to the vertical axis and centerline of the frustroconical base 34.

The frustroconical base 34 of the C-shaped refractory anchor anchor 30 is structurally and functionally similar to the frustroconical base of the S-bar refractory anchor described above with respect to FIGS. 6–8. The flared, tapered slanted sides 34*c* and 34*d* of the frustroconical base diverge generally towards and intersect the C-shaped arcuate ends 31*a* and 31*b* of the crossbar of the overhead crossbar 31 at obtuse angles of inclination ranging from 95 degrees to 150 degrees and preferably at a maximum of 135 degrees to define obtuse pockets 34*e* and 34*f* therewith for receiving the refractory lining. The frustroconical base has a generally planar or flat frustroconical body portion which is positioned in coplanar relationship with the flat intermediate portion 31*c* of the crossbar. The base can have one or more holes 32*a–e* with optional outwardly extending tabs 33*a–e* along the vertical axis of the base. The C-shaped opposite ends 31*a* and 31*b* provide outwardly extending arms which are curved in transverse direction normal to and away from the plane of the base. Each of the C-shaped ends (arcuate portions) 31*a* and 31*b* arcuately extends at an angle ranging from 60 degrees to 270 degrees and preferably from about 100 degrees to about 180 degrees from the beginning to the end of the C-shaped end relative to the intermediate portion 31*c* of the crossbar. The score, break, or cutting lines 34*g–j* have a similar orientation and function as the cutting lines 14*g–j* of the S-shaped refractory anchor in FIGS. 6–8. The overall dimensions and proportional relationships of the crossbar 31 and base 34 of the C-shaped refractory anchor are similar to the dimensions and proportional relationship of the crossbar and base of the S-shaped refractory anchor of FIGS. 6–8.

The S-shaped, C-shaped, and X-shaped refractory anchors can be installed in new reactors or other units and can be used to repair or patch existing units. During repair, the damaged refractory can be stripped to have access to the vessel or conduit surface, the refractory anchors can then be welded to the exposed surface, and the refractory redeposited.

The S-shaped, C-shaped, and X-shaped refractory anchors are particularly useful to resist erosion and increase the useful life of refractory linings in reactors and other vessels.

Although embodiments of this invention have been shown and described, it is to be understood that various modifications and substitutions, as well as rearrangements of parts and components, can be made by those skilled in the art without departing from the novel spirit and scope of this invention.

What is claimed is:

1. A refractory anchor for minimizing erosion and increasing the useful life of refractory linings in reactors and other vessels, comprising:

an overhead elongated crossbar having opposite ends and an intermediate portion positioned between and connecting said opposite ends, at least one of said opposite ends having an arcuate portion defining a curved baffle for arcuately deflecting and substantially blocking gases flowing along the refractory lining adjacent said refractory anchor; and a base extending generally downwardly from said intermediate portion of said crossbar for reinforcing said refractory lining, said base having a generally planar frustroconical body portion with flared sides diverging generally upwardly towards said crossbar, said sides intersecting said opposite ends, respectively, of said crossbar at obtuse angles of inclination and cooperating with said ends of said crossbar to define pockets for receiving said refractory lining, said base having a crossbar-connecting portion positioned adjacent and connected to said crossbar, said crossbar-connecting portion defining the maximum lateral span of said base, said base having a bottom portion positioned opposite and away from said crossbar-connecting portion and spanning a lateral distance substantially less than said crossbar-connecting portion; and said intermediate portion of said crossbar being substantially planar and lying in substantially the same plane and being positioned substantially in coplanar relationship with said planar frustroconical body portion and said intermediate portion of said crossbar spanning a distance substantially greater than the maximum lateral span of said base.

2. A refractory anchor in accordance with claim 1 wherein said obtuse angles each range from about 95 degrees to about 150 degrees.

3. A refractory anchor in accordance with claim 1 wherein said obtuse angles are each a maximum of about 135 degrees.

4. A refractory anchor in accordance with claim 1 wherein said opposite ends of said crossbar have reverse bent arcuate portions.

5. A refractory anchor in accordance with claim 1 wherein said opposite ends of said crossbar have laterally symmetrical arcuate portions.

6. An S-bar refractory anchor for minimizing erosion and increasing the useful life of refractory linings in reactors and other vessels, comprising:

a generally S-shaped crossbar having an intermediate portion with reverse bent arcuate opposite ends, said reverse bent ends being cantilevered from said intermediate portion and providing complimentary curved baffles for arcuately deflecting and substantially blocking gases flowing along the refractory lining adjacent said refractory anchor;

a generally frustroconical base having a substantially planar body portion extending integrally from and connected to said intermediate portion of said S-shaped crossbar for reinforcing said refractory lining, said frustroconical base having a bottom portion spanning a lateral distance less than said intermediate portion of said crossbar and having tapered sides diverging generally towards and intersecting said reverse bent arcuate ends at obtuse angles of inclination to define obtuse pockets therewith for receiving said refractory lining; and a substantial part of said intermediate portion of said crossbar being in substantially coplanar relationship with said planar body portion of said frustroconical base and cooperating with said planar body portion of said base to provide a generally T-shaped member.

7. An S-bar refractory anchor in accordance with claim 6 wherein said crossbar is generally S-shaped as viewed from the top.

8. An S-bar refractory anchor in accordance with claim 6 wherein said frustroconical base defines at least one refractory lining-receiving hole and has an overall height ranging from about 0.25 inch to about 3.75 inches and said S-shaped crossbar has an overall length of about 2 inches to about 6 inches.

9. An S-bar refractory anchor in accordance with claim 6 wherein said obtuse angles each range from about 95 degrees to about 150 degrees.

10. An S-bar refractory anchor in accordance with claim 6 wherein said obtuse angles are each a maximum of 135 degrees and said S-shaped crossbar has a maximum length of about 5 inches.

11. An S-bar refractory anchor in accordance with claim 6 wherein the overall length of said crossbar is at least twice as long as the overall height of said frustroconical base.

12. An S-bar refractory anchor in accordance with claim 6 wherein each of said reverse bent ends extends arcuately from said intermediate portion of said crossbar from about 60 degrees to about 270 degrees.

13. An S-bar refractory anchor in accordance with claim 12 wherein each of said reverse bent ends extends arcuately from said intermediate portion of said crossbar from about 100 degrees to about 180 degrees.

14. A C-shaped refractory anchor for minimizing erosion and increasing the useful life of refractory linings in reactors and other vessels, comprising:

a generally C-shaped crossbar having an intermediate portion with substantially symmetrical C-shaped opposite ends, said C-shaped opposite ends being cantilevered from said intermediate portion and generally facing each other to provide symmetrical curved baffles for arcuately deflecting and substantially blocking gases flowing along the refractory lining adjacent said refractory anchor;

a generally frustroconical base having a substantially planar body portion extending integrally from and connected to said intermediate portion of said C-shaped crossbar for reinforcing said refractory lining, said frustroconical base having a crossbar connecting portion integrally connected to said crossbar and having a bottom portion spanning a lateral distance substantially less than said crossbar-connecting portion, said base having slanted sides diverging generally towards and intersecting said C-shaped arcuate ends at obtuse angles of inclination to define obtuse pockets therewith for receiving said refractory lining; and said intermediate portion of said crossbar being in substantially coplanar relationship to said planar body portion of said frustroconical base and being integrally connected to and cooperating with said frustroconical base to define a unitary, one-piece integral refractory anchor.

15. A C-shaped refractory anchor in accordance with claim 14 wherein said crossbar is generally C-shaped as viewed from the top and said crossbar cooperates with said base to provide a generally T-shaped member as viewed from the front.

16. A C-shaped refractory anchor in accordance with claim 14 wherein said frustroconical base has an overall height ranging from about 0.25 inch to about 5 inches, said C-shaped crossbar has an overall length of about 2 inches to about 6 inches, and said obtuse angles each range from about 95 degrees to about 150 degrees.

17. A C-shaped refractory anchor in accordance with claim 14 wherein the overall length of said crossbar is at least twice as long as the overall height of said frustroconical base.

18. A C-shaped refractory anchor in accordance with claim 14 wherein said frustroconical base defines at least one hole for receiving and engaging a refractory lining.

19. A C-shaped refractory anchor in accordance with claim 18 wherein said frustroconical base includes a tab adjacent said hole for receiving and engaging a refractory lining.

20. A C-shaped refractory anchor in accordance with claim 14 wherein each of said C-shaped ends extends arcuately from said intermediate portion of said crossbar from about 60 degrees to about 270 degrees.

21. A C-shaped refractory anchor in accordance with claim 20 wherein each of said C-shaped ends extends arcuately from about 100 degrees to about 180 degrees.

* * * * *